United States Patent [19]

Peter

[11] 4,074,502

[45] Feb. 21, 1978

[54] METHOD FOR MANUFACTURING A SUPPORT FRAMEWORK

[76] Inventor: Emil Peter, Rosentalstrasse 78, Winterthur, Switzerland

[21] Appl. No.: 733,276

[22] Filed: Oct. 18, 1976

[30] Foreign Application Priority Data

Oct. 22, 1975 Switzerland ..... 13674/75

[51] Int. Cl.[2] ..... E04B 1/00; E04B 7/00

[52] U.S. Cl. ..... 52/741; 52/82; 52/83; 52/747; 264/32; 264/228

[58] Field of Search ..... 52/743, 741, 747, 80, 52/82, 225, 648, 573; 264/32, 228

[56] References Cited

U.S. PATENT DOCUMENTS

| | | | |
|---|---|---|---|
| 1,390,073 | 9/1921 | Allen | 52/648 |
| 2,183,451 | 12/1939 | Forster | 52/225 X |
| 2,360,285 | 10/1944 | Sherman | 52/747 X |
| 2,380,953 | 8/1945 | DuBassoff | 52/225 |
| 2,411,651 | 11/1946 | Darby | 52/82 |
| 2,577,582 | 12/1951 | Hammitt et al. | 52/225 X |
| 2,699,739 | 1/1955 | Molke | 52/747 X |
| 3,029,490 | 4/1962 | Middendorf | 264/228 |
| 3,041,702 | 7/1962 | Schwab | 264/228 |
| 3,153,302 | 10/1964 | Wheeler | 52/82 X |
| 3,153,303 | 10/1964 | Wheeler | 52/82 |
| 3,410,039 | 11/1968 | Brezina | 52/80 |
| 3,967,423 | 7/1976 | Hammond | 52/573 |

*Primary Examiner*—Price C. Faw, Jr.
*Assistant Examiner*—Robert C. Farber
*Attorney, Agent, or Firm*—Diller, Brown, Ramik & Wright

[57] ABSTRACT

A method of manufacturing a support framework or truss having at least one suspension element arched in one direction and serving as a roof construction, formed from concrete poured at the site or from prefabricated components, comprising forming a reinforcement construction taking-up the horizontal forces and composed of two horizontal supports arranged in spaced relationship from one another and extending transversely with respect to the arching direction of the suspension element, and which horizontal supports are laterally interconnected by means of reinforcement components, and supporting the thus formed reinforcement construction upon supports. Tension elements for the suspension element are arranged in a spatial curve extending in a catenary configuration between the horizontal supports and are anchored at the region of the supports at the reinforcement construction. Before or after anchoring of the tension elements there are attached to the tension elements the forms for building from concrete the suspension element, i.e., the form elements for building from concrete the joints between the fabricated components.

27 Claims, 6 Drawing Figures

METHOD FOR MANUFACTURING A SUPPORT FRAMEWORK

BACKGROUND OF THE INVENTION

The present invention relates to a new and improved method of manufacturing a support truss of framework which possesses at least one suspension element serving as the roof construction and arched or domed in one direction.

SUMARY OF THE INVENTION

It is a primary object of the present invention to provide a novel method of manufacturing a support framework or truss of the aforementioned type, by means of which there can be erected a support framework or truss possessing greater a span width than that of conventional frameworks, without the need to erect a scaffold.

Now in order to implement these and still further objects of the invention, which will become more readily apparent as the description proceeds, the invention contemplates supporting at supports a reinforcing or stiffening construction taking up the horizontal forces and which is formed from two horizontal supports spaced from one another and extending transversely to the direction of arching of the suspension element and laterally interconnected by means of reinforcement components. The tension elements for the suspension element are arranged in a spatial curve extending in a catenary configuration between the horizontal supports and anchored at the region of the supports at the reinforcement construction. Further, before or after the anchoring of the tension elements the forms for the formation from concrete of the suspension element and especially the form elements for forming from concrete the joints between the fabricated components are secured to the tension elements.

Due to the fact that the load-carrying capability of the tension elements is already employed at an early stage during the erection of the truss or support framework, it is possible to beneficially dispense with the need to erect a scaffold.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Figure 2:
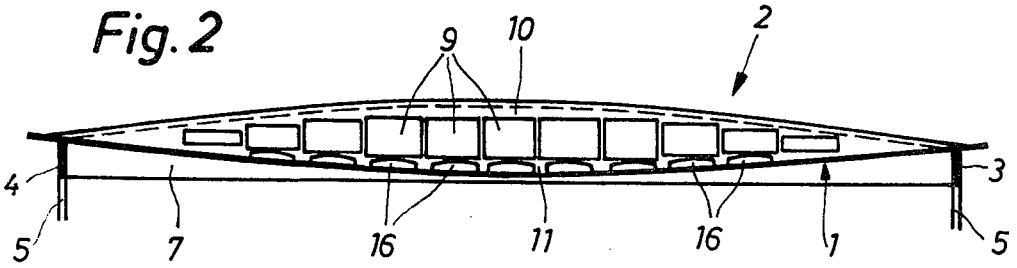
FIG. 2 is a longitudinal sectional view through the suspension element, taken substantially along the line II—II of FIG. 1.
Figure 1:
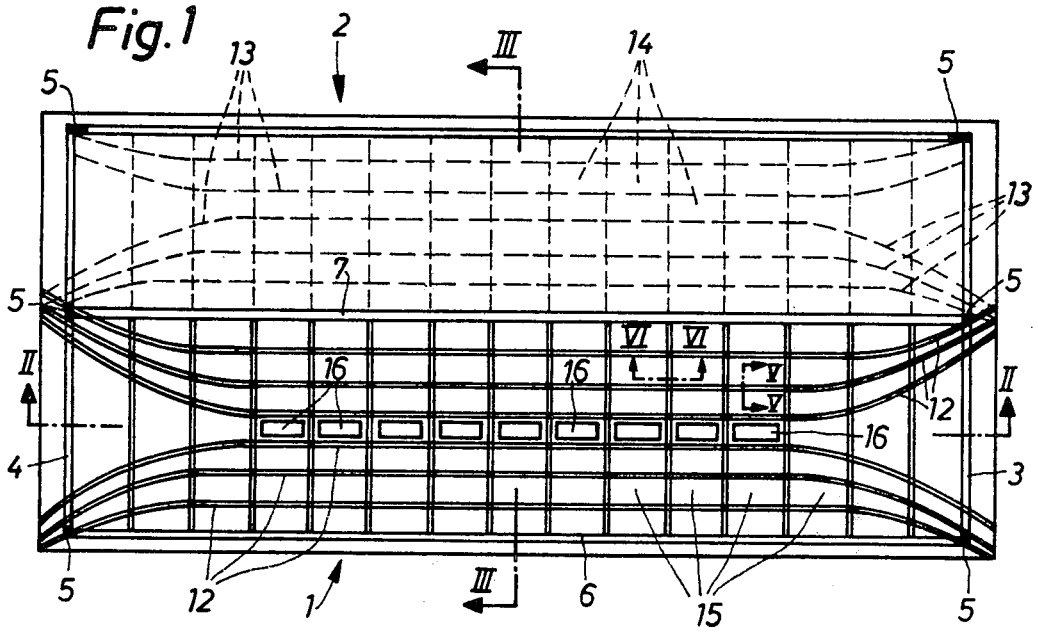
FIG. 1 is a bottom plan view of a support framework or truss constructed according to the present invention.
Figure 3:
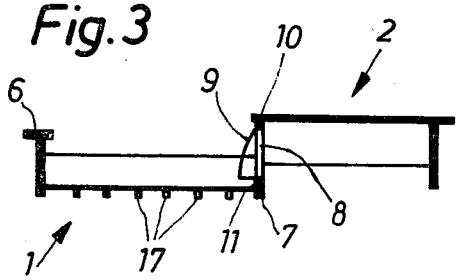
FIG. 3 is a cross-sectional view through the truss or framework, taken along the line III—III of FIG. 1.

Describing now the drawings, with the exemplary embodiment of support framework or truss illustrated in FIGS. 1 to 3, it will be seen that a compression arch or dome 2 is arranged adjacent a tension arch or dome 1 constructed as a suspension element. The tension arch or dome 1 and the compression arch or dome 2 are curved opposite to one another in one direction in catenary-shape and supported upon the supports 5 by means of horizontal supports 3, 4 constructed as eave tie beams or girders. At the lengthwise side opposite the compression arch 2 there is provided a truss compression tie beam 6.

At the region of its ends the compression arch or dome 2 is preferably constructed as a support plate of framework disc for transmission of compressive loads.

The tie beam ribs or members 7 between the tension arch 1 and the compression arch 2 are provided with window openings 8 in order to reduce the inherent weight. With very large span widths the window openings 8 are formed of corresponding height, so that it is of advantage to provide at these windows plastic bowls or domes 9 which transmit the wind loads directly to the lintel or upper region 10 and bank or lower region 11.

In FIG. 1 there have been illustrated the tension or traction elements 12 in the tension arch 1 and the support lines 13 in the compression dome 2. These tension elements 12 are anchored at the region of the supports 5 through the agency of such supports 5 at the horizontal supports 3, 4. The tension elements 12 of the tension arch 1 extend in a catenary spatial curve between the supports 5.

With the exemplary embodiment under discussion the support framework or truss is produced from fabricated components 14 and 15 in a manner still to be described, yet, it would be also possible to construct the framework from concrete poured at the site.

In order to improve the room illumination the fabricated components 15 of the tension arch 1 can have installed thereat skylight cupolas or domes 16 (FIGS. 1 and 2).

In FIG. 3 there are arranged at the underside of the tension or traction arch 1 joint form or formwork elements 17 which extend in the arching or curving direction of the tension arch 1 and in which there extend the tension elements 12 n a manner still to be described.

Figure 4:
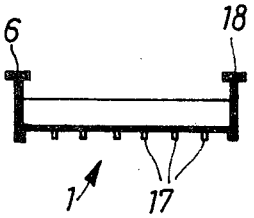
FIG. 4 is a cross-sectional view, analagous to the showing of FIG. 3, through a suspension element.

FIG. 4 illustrates, in a manner analagous to FIG. 3, a cross-section through a tension arch 1 which possesses at the side opposite the truss compression tie beam 6, instead of the compression arch 2, a second truss compression tie beam 18. In all other respects the tension arch 1 of FIG. 4 corresponds to the tension arch 1 of FIGS. 1 to 3, and thus in these figures the same components have been generally designated with the same reference characters.

The horizontal supports 3, 4 together with the truss compression tie beams 6, 18 and the compression dome 2 form a reinforcing or stiffening construction supported at the supports 5 and serving to take up the horizontal forces.

Figure 6:
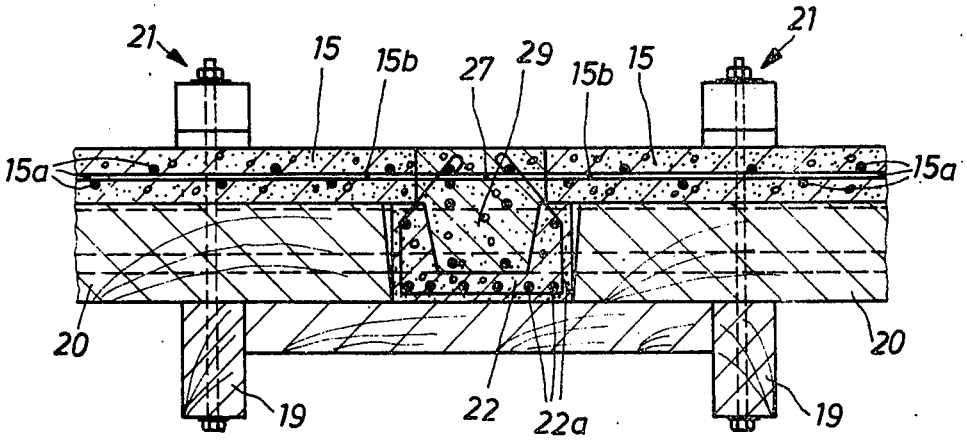
FIG. 6 is a cross-sectional view, taken substantially along the line VI—VI of FIG. 1.
Figure 5:
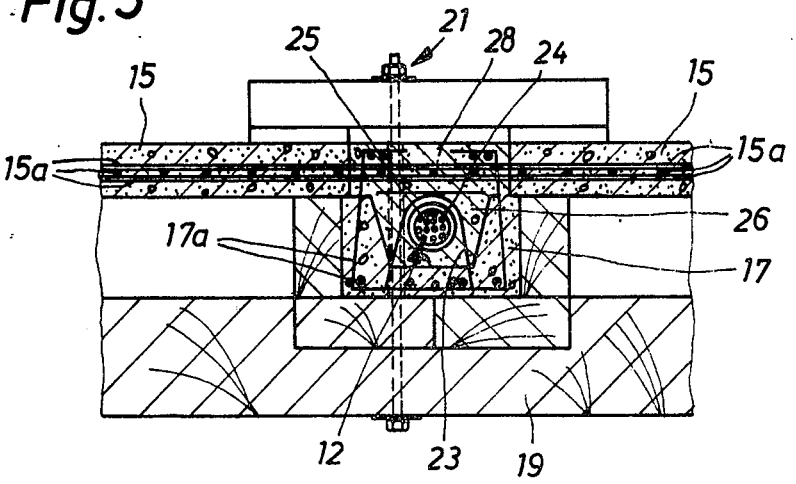
FIG. 5 is a cross-sectional view, taken substantially along the line V—V of FIG. 1.

Based upon the showing of FIGS. 5 and 6 there will be now explained the fabrication of the tension arch or dome 1. FIG. 5 illustrates a section through a longitudinal joint, and FIG. 6 a section through a transverse joint between two fabricated components 15 of the tension arch 1.

At the floor of the hall to be covered there is erected an auxillary construction composed of transverse supports 19 and supports 20 bearing thereon. The supports 19, 20, typically formed of wood, are interconnected by means of threaded connections 21. At the transverse supports 19 there are attached the substantially U-shaped joint concrete from elements 17 for the longitudinal or lengthwise joints (FIG. 5) and the likewise substantially U-shaped joint concrete form elements 22 for the transverse joints (FIG. 6). The joint form elements 17, 22 comprise prefabricated elements formed of concrete and are provided with suitable concrete reinforcements, such as reinforcing wires 17*a* and 22*a* respectively.

In the grooves of the joint concrete form elements 17 there are now inserted the tension or traction elements 12 and such then held by means of the associated anchoring element 23. The tension elements 12, in the illustrated exemplary embodiment, consist of tension cables or wires 25 arranged within the jacket or sheath tubes 24. In order to maintain the minimum tension cable-radii of curvature and to take up the horizontal cable deflection forces, the jacket tubes 24 are partially encased in concrete, as such has been indicated in FIG. 5 by reference character 26. At the regions of the joint form elements or formwork 22 extending transversely with respect to the direction of arching or doming of the tension arch the jacket tubes 24 are not encased in concrete, since these regions should function in the manner of hinge of pivot joints.

Now the auxiliary construction together with the joint form elements 17, 22 and the tension elements 12 are lifted by means of cranes or the like to the eaves height of the already erected reinforcement construction supported upon the supports 5 and consisting of the frame compression tie beams 6, 18 and the compression dome 2. The tension elements 12 are anchored at their ends together with the corresponding joint form elements 17 at the region of the supports 5 at the reinforcement construction. After lowering the crane load the tension elements 12 transmit the entire load to the supports 5, and the horizontal components of the anchoring forces appearing at the anchoring locations of the tension elements 12 are taken up by the reinforcement construction.

The tension elements 12 extend between the supports 5 in a catenary spatial curve which they automatically assume due to the load acting thereat. At their central region the tension elements 12 are arranged parallel to one another.

Now the prefabricated components 15 are layed in an exactly predetermined sequence at the joint form elements 17, 22. The finished or fabricated components consist of concrete and are provided with suitable reinforcement or armoring 15*a*, such as reinforcing wires or rods.

The main reinforcement rods 15*b* of the fabricated components 15, and which extend in the direction of the tension elements 12, are welded together at their contact or abuttment locations 27 (FIG. 6).

After all of the fabricated components 15 have been assembled and the primary or main reinforcement rods 15*b* welded to one another, there also can be formed in concrete the longitudinal abutment joints 28 (FIG. 5) and the transverse contact or abutment joints 29 (FIG. 6), and the elements 17 and 22 serve as form elements. The tension arch 1 has now assumed its final catenary-shape. The tension cables 25 now transmit the entire load to the supports 5. After sufficient hardening or setting of the concrete the tension cables 25, as required, can be additionally pre-tensioned. Under circumstances there is not however required any pre-tensioning of the tension cables 25.

After having produced the support framework or truss the auxiliary construction is removed by loosening the threaded connections 21.

The joint concrete form elements 17, 22 need not be prefabricated elements and can also be differently constructed. Moreover, it is also conceivable to initially anchor the tension elements 12 at the reinforcement construction and only thereafter to secure the joint form elements 17, 22 at the tension elements 12 extending in a catenary-shape between the supports 5.

The described truss or support framework also can be produced in concrete poured at the site. It is possible to secure the form at the floor or ground at the tension elements 12, to then raise the tension elements 12 together with the concrete form to the height of the eave and to anchor the tension elements 12 at the reinforcement construction, in the manner as already previously described. However, it is also possible to first anchor the tension elements at the reinforcement construction and then first thereafter to secure the concrete form at the tension elements 12. The concrete is then first poured after the tension elements 12 together with the concrete form are attached at the reinforcement construction.

Since, as described, the load-carrying capability of the tension elements has already been used quite early during fabrication, it is possible to dispense with the erection of a scaffold.

Since the tension arch or dome is subdivided into many elements of a size favorable for pre-fabrication, the span width can be increased in relation to conventionally pre-fabricated support frameworks or trusses by twice or threefold.

While there are shown and described present preferred embodiments of the invention, it is to be distinctly understood that the invention is not limited thereto, but may be otherwise variously embodied and practiced within the scope of the following claims. Accordingly,

What is claimed is:

1. A method of manufacturing a support framework containing at least one suspension element arched in one direction and serving as a roof construction, said suspension element including a plurality of tension elements and a plurality of preformed fabricated components extending between said tension elements, and with said method comprising the steps of: forming a reinforcement construction for taking up horizontal forces with said reinforcement construction including two horizontal supports extending in spaced relation from one another transversely to the intended direction of arching of the suspension element and compression type reinforcement components interconnecting said two horizontal supports, supporting the reinforcement construction upon upstanding supports, arranging tension elements of the suspension element in a substantially catenary spatial curve between the horizontal supports and anchoring such tension elements to said reinforcement construction at the region of the upstanding supports, before or after anchoring of the tension elements attaching to the tension elements concrete form elements for forming from concrete joints between fabricated components of the support framework, supporting said fabricated components between said tensioning elements on said concrete form elements, and pouring concrete joints between said fabricated components.

2. The method as defined in claim 1, further including the step of constructing at least one of the reinforcement components as a truss compression tie beam.

3. The method as defined in claim 1, further including the step of constructing at least one of the reinforcement components as a compression arch which is arched opposite to the suspension element.

4. The method as defined in claim 3, including the step of constructing the compression arch at its ends as a support plate.

5. The method as defined in claim 1, wherein said concrete form elements are arranged at the floor of a structure to be covered by the suspension element with said concrete form elements being of substantially U-shaped cross-section, an auxiliary construction is secured to said concrete form elements, and the tension elements are inserted into the concrete form elements extending essentially in the direction of arching of the suspension element and are attached to said concrete form elements such to be substantially tension-proof therewith.

6. The method as defined in claim 5, including the step of pre-fabricating the concrete form elements.

7. The method as defined in claim 1, including the step of utilizing as the tension elements tension cables arranged in jacket tubes.

8. The method as defined in claim 1, including the step of utilizing as the tension elements tension cables arranged in jacket tubes and partially embedding in concrete the jacket tubes in the concrete form elements.

9. The method as defined in claim 5, including the step of lifting the tension elements together with the concrete form elements and the auxiliary construction to the height of the horizontal supports of the reinforcement construction, anchoring the ends of the tension elements at the region of the upstanding supports, and thereafter assembling the fabricated components on the concrete form elements.

10. The method as defined in claim 9, wherein the fabricated components have reinforcing rods extending in the direction of the tension elements and the method includes the step of welding together at the joint locations reinforcement rods of neighboring fabricated components.

11. The method as defined in claim 9, further including the step of forming of concrete abutment joints between neighboring fabricated components after assembly of the fabricated components with the tension elements.

12. The method as defined in claim 7, further including the steps of forming of concrete abutment joints between neighboring fabricated components after assembly of the fabricated components on the concrete form elements, and tensioning the tension cables after sufficient hardening of the concrete of the abutment joints.

13. The method as defined in claim 5, including the step of removing the auxiliary construction after completion of the support framework.

14. The method as defined in claim 1, wherein, when pouting the concrete joints, the concrete is poured into the concrete forms attached to the tension elements after anchoring the tension elements at the reinforcement construction.

15. The method as defined in claim 1, including the step of providing at least a part of the fabricated components with skylight domes.

16. The method as defined in claim 3, wherein there is a girder having ribs disposed between said suspension elements and said compression arch and said method includes the step of providing window openings between said girder ribs between the suspension element and the compression arch, and covering the window openings with plastic cups.

17. A method of forming a concrete suspension element, said method comprising the steps of providing a supporting frame, providing form elements formed as concrete channels, assembling the form elements as a unit on the supporting frame, positioning a tension element in each of at least certain of the form elements, anchoring remote ends of the tension elements to the supporting frame, anchoring the tension elements to respective ones of the form elements, assembling prefabricated concrete panels on the form elements in spaced relation, and pouring concrete joints between adjacent ones of the concrete panels.

18. The method of claim 17 wherein the tension elements are anchored to the respective form elements by pouring concrete around the tension elements within their respective form elements.

19. The method of claim 18 when the tension elements are anchored to their respective form elements after the tension elements are anchored to the supporting frame.

20. The method of claim 18 when the tension elements are anchored to their respective form elements before the unit is placed on the supporting frame.

21. The method of claim 17 wherein the form elements are arranged in intersecting longitudinal and transverse rows and wherein the tension elements at least prior to the pouring of the concrete joints are free of the form elements at the intersections between form elements.

22. The method of claim 17 wherein the form elements are arranged in intersecting longitudinal and transverse rows and wherein tension elements at least prior to the pouring of the concrete joints are free of the form elements at the intersections between form elements, and the tension elements and the form elements receiving the tension elements are downwardly arched in side elevation.

23. The method of claim 22 wherein the tension elements and the form elements receiving the tension elements have in plan parallel central portions and curved converging end portions, the end portions on opposite sides of a line of demarcation curving in opposite directions.

24. The method of claim 23 wherein the tension elements assume a catenary spacial curve.

25. The method of claim 17 wherein the concrete panels include reinforcing wires extending therefrom, joints are formed between the reinforcing wires of adjacent concrete panels, and the wire joints are embedded in the poured concrete joints.

26. A method of manufacturing a support framework with concrete poured at the site with the support framework containing at least one suspension element arched in one direction and serving as a roof construction, said method comprising the steps of: forming a reinforcement construction for taking up horizontal forces with the reinforcement construction including two horizontal supports extending in spaced relation from one another transversely to the direction of arching of the suspension element and reinforcement components laterally interconnecting the two horizontal supports;

supporting the reinforcement construction upon supports, arranging tension elements of the suspension element in a substantially catenary spatial curve between the horizontal supports and anchoring such tension elements at the region of the supports at the reinforcement construction; and before or after anchoring of the tension elements attaching to the tension elements forms, and pouring in situ in said forms concrete encasing said tension elements.

27. The method of claim 26 wherein the concrete is poured after the anchoring of the tension elements to the reinforcement construction.

* * * * *